United States Patent [19]

Slinn

[11] Patent Number: 4,583,742

[45] Date of Patent: Apr. 22, 1986

[54] BLOCK AND BOARD PUZZLE GAME

[76] Inventor: Barry Slinn, 49 Fourier Drive SE., Calgary, Alberta, Canada, T2A 2C2

[21] Appl. No.: 624,356

[22] Filed: Jun. 25, 1984

[51] Int. Cl.[4] ..... A63F 3/02; A63F 9/08; A63F 9/12

[52] U.S. Cl. ..... 273/260; 273/153 J; 273/157 R; 273/160; 273/261; 273/282; 273/283; 273/284

[58] Field of Search ..... 273/156, 157 R, 153 J, 273/160, 260, 282 B, 282 C, 283, 261, 284

[56] References Cited

U.S. PATENT DOCUMENTS 3,929,337 12/1975 Hayes ..... 273/282 B X

FOREIGN PATENT DOCUMENTS 1154 of 1906 United Kingdom ..... 273/160

OTHER PUBLICATIONS

"Polyominoes" by Solomon W. Golomb, publ. by Charles Scribner's Sons, New York, copyright 1965, pp. 24,25,31,116,117,158,159.

*Primary Examiner*—Anton O. Oechsle
*Attorney, Agent, or Firm*—William R. Hinds

[57] ABSTRACT

A puzzle game includes a game board with a square playing surface, and a plurality of blocks defined by cubes, at least one of the blocks being a single cube and the remaining blocks including two or more cubes defining L-shaped, T-shaped, cruciform and straight blocks. The blocks can be arranged on the board to cover the entire playing surface, or stacked to form a cube, T-shaped walls or sets of stairs. Recesses can be provided in one surface of the blocks for receiving pegs, which increases the number of games which can be played with the puzzle game.

1 Claim, 7 Drawing Figures

BLOCK AND BOARD PUZZLE GAME

BACKGROUND OF THE INVENTION

This invention relates to a puzzle game, and in particular to a block and board puzzle game.

The patent literature relating to games is decidedly voluminous. There are a large number of patents relating to games or puzzles, which can be played with blocks and/or boards. Typical of such patents are U.S. Pat. Nos. 3,065,970, issued to S. S. Besley on November 27, 1962 and 4,153,254 issued to M. Marc on May 8, 1979. These two patents relate to block puzzles, which include a plurality of blocks which can be assembled to produce three dimensional cubes or other polyhedral structures. However, there still exists a need for a puzzle game which has multiple uses, i.e. which can be played or used in a variety of manners.

The object of the present invention is to provide a relatively simple puzzle game which can be used as a puzzle by one or more players or used as a game by one or more players.

SUMMARY OF THE INVENTION

Accordingly, the present invention relates to a puzzle game comprising: (a) a game board with a rectangular playing surface; and (b) a plurality of blocks defined by one or more similar cubes, at least one of the blocks being a single cube and the majority of the blocks including two or more cubes defining L-shaped, T-shaped, cruciform and straight blocks, the blocks being capable of defining a rectangle occupying the entire playing surface, the blocks also being capable of defining other geometric figures including a cube, a T-shaped wall and stairs, there being at least one recess in a top surface of each block, the number of recesses in each block being equal in number to the number of cubes defining the block, and peg means removably insertable in the recesses.

BRIEF DESCRIPTION OF THE DRAWINGS

The invention will now be described in greater detail with reference to the accompanying drawings, which illustrate preferred embodiments of the invention and wherein.

DESCRIPTION OF THE PREFERRED EMBODIMENTS

Figure 1:
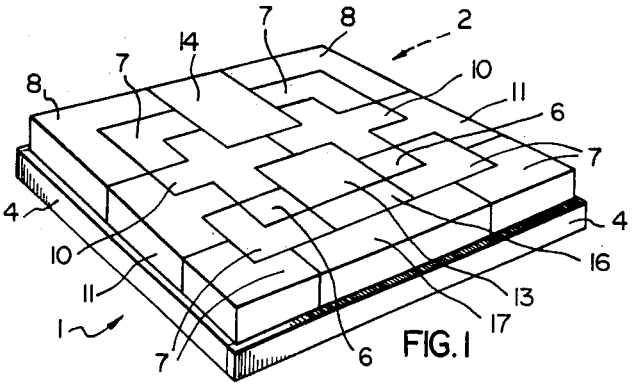
FIG. 1 is a perspective view from above of a puzzle game in accordance with the present invention.
Figure 2:
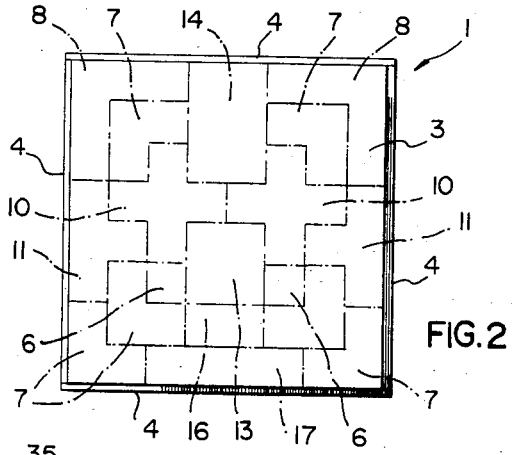
FIG. 2 is a plan view of the puzzle game of FIG. 1 with the blocks removed.

With reference to FIGS. 1 and 2, the simplest form of the puzzle game of the present invention includes a square board generally indicated at 1 for supporting seventeen blocks generally indicated at 2. The board 1 is defined by a planar base, defining a playing surface 3 and raised side walls 4. The blocks 2 define a plurality of polyhedrons, which are best shown in FIG. 2. Each block 2 is defined by one or more small cubes. The cubes are all the same size. In fact, two of the blocks 6 are small cubes. Six of the blocks 7 are small, symetrical L's defined by three cubes. Two of the blocks 8 are larger symetrical L's formed by five cubes. Two of the blocks 10 are cruciform, including five cubes. Two of the blocks 11 are T-shaped, being defined by four cubes. Two of the blocks 13 and 14 are rectangular, one block 13 being formed by four cubes and the other block 14 including six cubes. The remaining two blocks 16 and 17 are straight, being defined by two and four blocks respectively.

The playing surface 3 can be provided with small raised partitions (not shown) defining the shapes of the blocks 2. Alternatively grooves (not shown) can be provided between adjacent cubes defining the multi-cube blocks 2, and the partitions on the playing surface 3 can define small squares equal in area to the area of one face of a cube. Thus, once positioned in the board 1, the blocks 2 will not move horizontally.

It will be noted that the blocks 2 can be arranged in the border defined by the side walls 4 to form a rectangle occupying the entire playing surface 3. The blocks 2 can also be used as the elements of a puzzle to form other geometric figures such as a cube, a set of stairs or a T-shaped wall.

Figure 3:
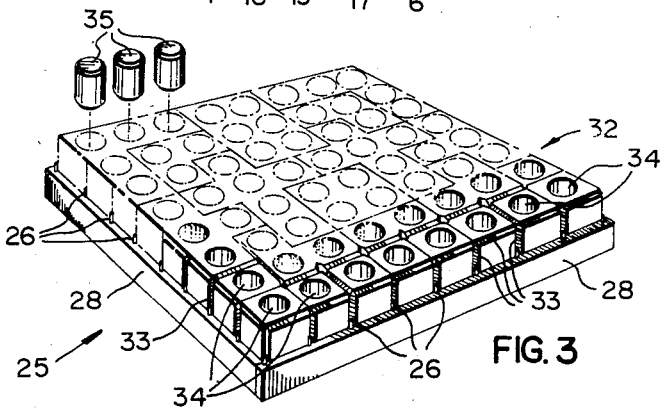
FIG. 3 is a partially exploded, perspective view of a second embodiment of the puzzle game of the present invention.
Figure 4:
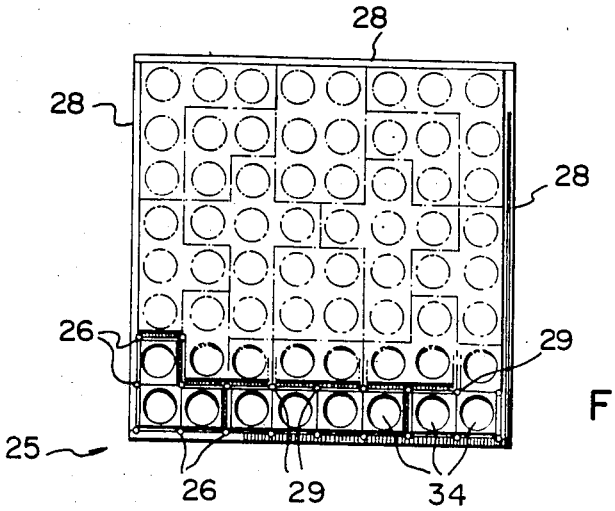
FIG. 4 is a plan view of the puzzle game of FIG. 3.

Referring to FIGS. 3 and 4, the second embodiment of the invention is quite similar to the first embodiment. The puzzle game of FIGS. 3 and 4 includes a board generally indicated at 25 similar to the board 1, except that pins 26 are provided on the side walls 28, and pins 29 are provided on the playing surface 30 of the board. The pins 26 and 29 are spaced apart by a distance equal to the length of each face of the cubes defining blocks 32.

The blocks 32 are the same as the blocks 2, except that the edges 33 thereof are notched for sliding onto the pins 26 and 29. Cylindrical recesses 34 are provided in the top surfaces of the blocks 32 for receiving cylindrical pegs 35.

The blocks 32 can be used in the same manner as the blocks 2, i.e. arranged in the border defined by the side walls 28 of the board 25, or arranged to form a variety of structures such as a cube, stairs or wall. Alternatively, the blocks 32 and pegs 35 can be used in a variety of other games.

Figure 5:
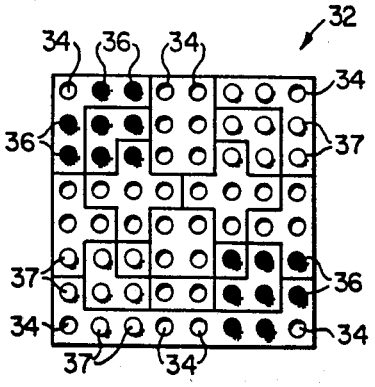
FIGS. 5 to 7 are diagrammatic plan views illustrating uses of the embodiment of FIGS. 3 and 4 in other games.

For example, as shown in FIG. 5, the pegs 36 and 37 can be black and white, respectively or any other two colours. The pegs 36 and 37 are a arranged in recesses 34 at the corners of the board, leaving a pair of rows of recesses 34 between adjacent groups of pegs. One player moves a peg 36 first, and the other player follows. The pegs 36 and 37 can be moved one square horizontally, vertically or diagonally. A peg 36 or 37 can jump an opposing peg to capture such opposing peg. If a jump can be made but is missed, the opposing player has the option of removing the peg for not jumping. If one player can make a two or more player jump (as in checkers), there is no penalty for taking one opposing peg only. All jumped pegs 36 or 37 are considered captured, and are removed from the board. In order to capture one of the blocks 32, the block must first be occupied and then left void of all pegs 36 or 37. Once all pegs have been removed, the block 32 is removed and retained by the capturing player until the end of the game. If a block 32 is captured but not removed, the block must be recaptured by being occupied and then vacated - there is no penalty.

Figure 6:
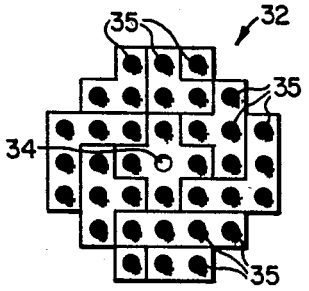
Figure 7:
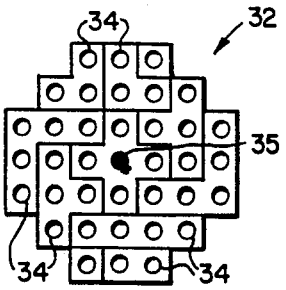

Referring to FIGS. 6 and 7, the board and blocks 32 can be used to play French solitaire. The blocks 32 are arranged on the board in the manner shown in FIG. 6, and pegs 35 are placed in all but the centre recess 34. The pegs 35 are jumped horizontally or vertically but not diagonally. Jumped pegs 35 are removed from the board, and the player attempts to leave one peg only at the centre of the board. The player can attempt to form a variety of other finishing peg patterns such as a centre peg and four pegs defining a square around such centre peg.

Another game which can be played with either embodiment of the invention is the placing of all of the blocks 2 or 32 in a single pile. Each of two players takes alternate turns placing a block on the board. The winner is the last player to be able to place a block 2 or 32.

Other variants are possible, and the player can be invited to invent his or her own game. The use of a rectangular game board and the basic set of symetrical blocks 2 or 32 makes it possible to construct a variety of puzzles. The addition of recesses 32 and pegs 35 multiplies the number of games or puzzles which can be played using the puzzle game of the present invention.

What I claim is:

1. A puzzle game comprising:

(a) a game board with a rectangular playing surface; and (b) a plurality of blocks defined by one or more similar cubes, at least one of the blocks being a single cube and the majority of the blocks including two or more cubes defining L-shaped, cruciform and straight blocks, the blocks being capable of defining a rectangle occupying the entire playing surface, the blocks also being capable of defining other geometric figures including a cube, a T-shaped wall and stairs, at least one recess in a top surface of each said block, the number of recesses in each block being equal in number to the number of cubes defining the block, and peg means removably insertable in said recesses.

* * * * *